US005598977A

United States Patent [19]

Lemme

[11] Patent Number: 5,598,977

[45] Date of Patent: Feb. 4, 1997

[54] ROTARY IRRIGATION SPRINKLER NOZZLE WITH IMPROVED DISTRIBUTION

[75] Inventor: Charles D. Lemme, Tucson, Ariz.

[73] Assignee: Anthony Manufacturing Corporation, Tucson, Ariz.

[21] Appl. No.: 384,918

[22] Filed: Feb. 7, 1995

[51] Int. Cl.[6] ..... B05B 3/00

[52] U.S. Cl. ..... 239/246; 239/DIG. 1

[58] Field of Search ..... 239/246, 248, 239/249, DIG. 1

[56] References Cited

U.S. PATENT DOCUMENTS

| | | | |
|---|---|---|---|
| 3,716,192 | 2/1973 | Hunter | 239/205 |
| 4,681,259 | 7/1987 | Troup et al. . | |
| 4,867,378 | 9/1989 | Kah, Jr. . | |
| 5,086,977 | 2/1992 | Kah, Jr. . | |
| 5,104,045 | 4/1992 | Kah | 239/246 |
| 5,141,157 | 8/1992 | Han | 239/206 |
| 5,240,182 | 8/1993 | Lemme . | |
| 5,240,184 | 8/1993 | Lawson . | |
| 5,299,742 | 4/1994 | Han . | |

*Primary Examiner*—Robert J. Oberleitner
*Assistant Examiner*—K. T. Bartz
*Attorney, Agent, or Firm*—Kelly, Bauersfeld & Lowry

[57] ABSTRACT

An irrigation sprinkler nozzle comprising a nozzle body having an elongated range nozzle passageway formed therethrough, a spreader nozzle outlet fed by a pressure reducing chamber disposed below the passageway, and a tertiary nozzle outlet disposed laterally of the passageway and above the spreader nozzle outlet, the tertiary nozzle outlet receiving water from the pressure reducing chamber through a pressure reducing flow port.

22 Claims, 2 Drawing Sheets

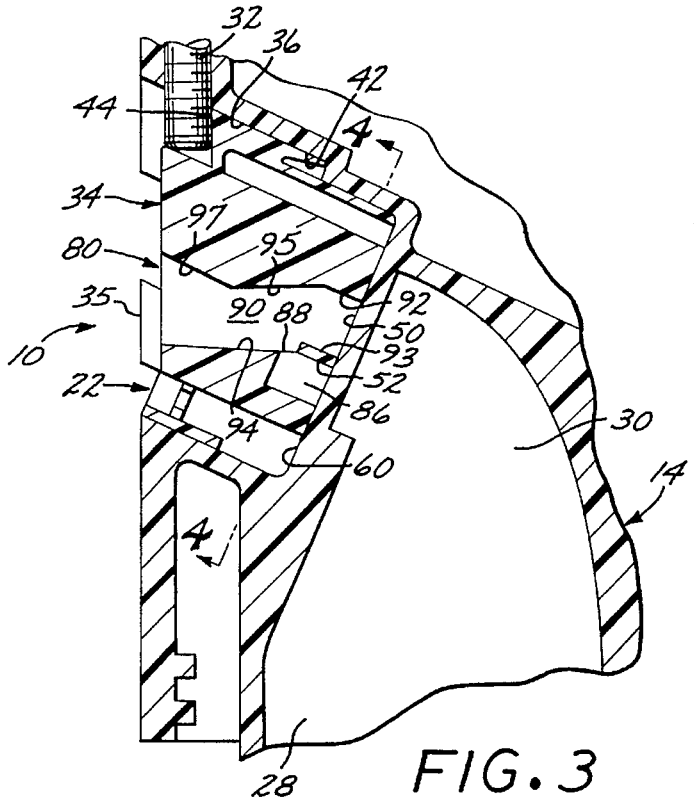
FIG. 3
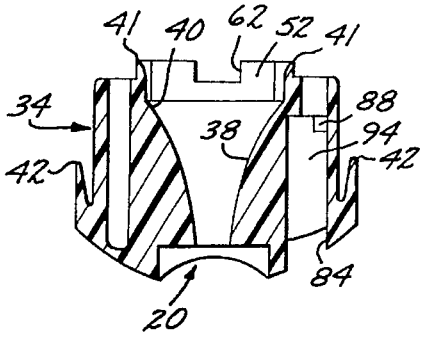
FIG. 5
FIG. 6
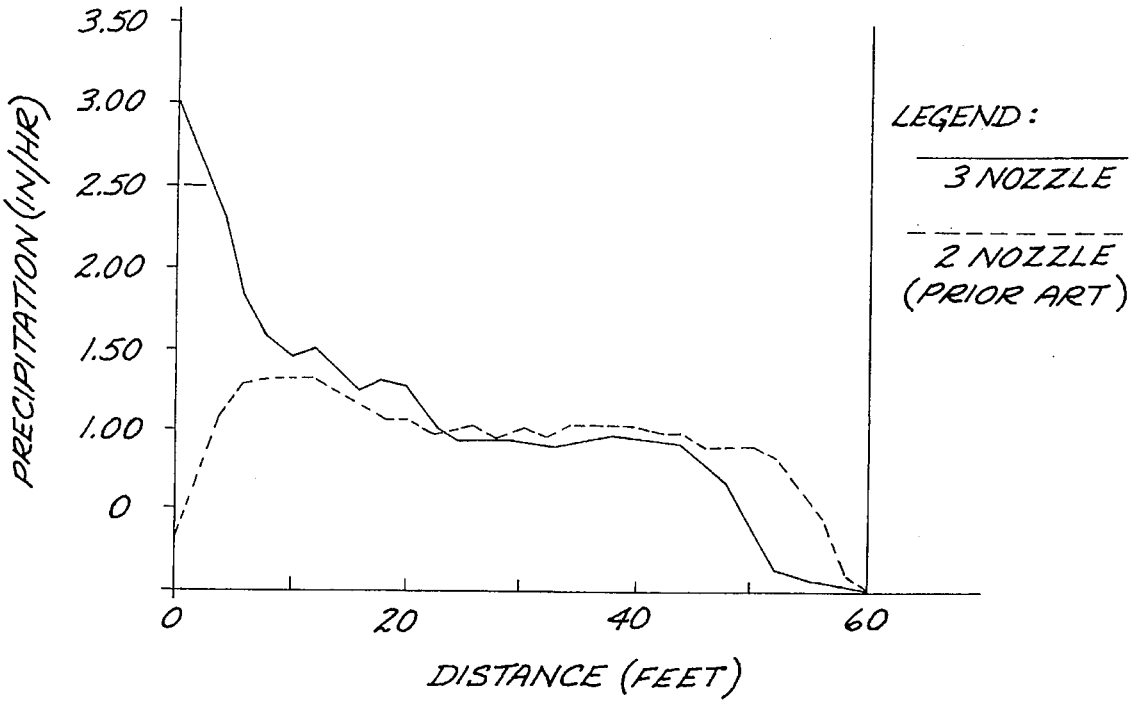

ROTARY IRRIGATION SPRINKLER NOZZLE WITH IMPROVED DISTRIBUTION

BACKGROUND OF THE INVENTION

This invention related to irrigation sprinkler nozzles, and more particularly to a new and improved sprinkler nozzle construction for enhancing the distribution pattern of water from a rotary sprinkler nozzle of the type including a primary or range nozzle and a secondary or spreader nozzle.

In many irrigation applications, particularly in commercial irrigation situations, irrigation sprinklers employ nozzles having two or more outlets, one nozzle, referred to as a "range nozzle" which is designed to produce a relatively large volume stream projected outwardly for maximum distance of throw, and another nozzle outlet referred to as a "spreader nozzle" which is designed to produce a smaller volume stream, and which is intended to fall out close in to the sprinkler for close in watering. In the ideal situation, the combined distribution pattern produced by the range nozzle and spreader nozzle would be a wedge shaped curve with maximum precipitation rate occurring at the sprinkler and decreasing linerally to zero at the maximum range.

While it is relatively straight forward to design a range nozzle to achieve maximum distance of throw, it is much more difficult to design a spreader nozzle to fill in the area between the sprinkler and the donut shaped area of coverage produced by the range nozzle. One reason why it is more difficult to design spreader nozzles to supply close in water is that small sized orifices and passageways have typically been thought necessary so that a relatively small droplet size spray is produced which will fall more quickly to the ground than the larger droplet size stream produced by the range nozzle. This is because smaller droplets have a much larger ratio of surface area to mass than larger droplets, so the small droplets lose energy through aerodynamic friction and slow down quickly allowing them to fall closer to the sprinkler than the larger droplets from the range nozzle. The use of small size orifices and passageways to produce small droplet size sprays have been found to have three major disadvantages. Firstly, small droplets are driven by even a slight breeze away from the intended destination, thereby producing erratic water distribution patterns. Secondly, it is very difficult to flow enough water through the small openings and passageways to produce sufficient water volume to achieve the desired close in precipitation rate, and thirdly, the small size of the openings and passages tend to result in clogs due to entrained particulate matter within the pressurized water system, thereby rendering the spreader nozzle ineffective.

Disclosed in U.S. Pat. No. 5,299,742, issued Apr. 5, 1994 and entitled IRRIGATION SPRINKLER NOZZLE is a rotary sprinkler nozzle construction which includes a spreader nozzle constructed in such a manner to enhance the distribution pattern of close in water without requiring small size orifices and passageways and which produces a spray pattern of controlled size and shape that is substantially unaffected by wind. As disclosed in that patent, the sprinkler nozzle includes a spreader nozzle constructed to produce a generally vertically oriented fan shaped spray with a lower portion of the spray being directed downwardly close in to the sprinkler, and an upper portion of the spray directed upwardly to interact with and become entrained in the stream from the range nozzle. By having a portion of the spray from the spreader nozzle become entrained in the stream from the range nozzle, a portion of the stream energy is transferred to the spray, thereby carrying the spray further away from the nozzle then would otherwise occur, and by directing a lower portion of the spray from the spreader nozzle downwardly, the amount of water applied in the immediate area around the sprinkler is increased. This then results in an overall enhancement of the distribution of water from the sprinkler nozzle without significant loss in overall range.

While use of nozzles constructed in accordance with the disclosure of the aforementioned '742 patent have been found to significantly enhance the distribution pattern produced by rotary sprinkler nozzles and have substantially eliminated the problem of spreader nozzle clogging, one problem that has been found to occur is that due to the relatively high velocity of the fan shaped spray produced by the spreader nozzle, the lower portion of the spray if directed downwardly close in to the sprinkler tends to impact on the adjacent soil with such force that erosion takes place and any seed therein planted is washed away. To eliminate this problem, it has been found necessary to direct the lower portion of the fan shaped spray produced by the spreader nozzle of the '742 patent further away from the sprinkler so that it does not fall to the ground until it has been projected outwardly approximately six to eight feet. This then results in a relatively dry donut shaped area extending outwardly around the sprinkler to approximately six to eight feet. As will become more apparent hereinafter, the present invention provides a new and improved nozzle construction which incorporates a third nozzle outlet in addition to a spreader nozzle of the type disclosed in the aforementioned '742 patent, and which provides close in water from the sprinkler outwardly to about six to eight feet. When the distribution pattern produced by the third nozzle outlet of the present invention is combined with the distribution pattern produced by the range nozzle and spreader nozzle, an overall precipitation distribution pattern is produced which very closely approximates the ideal wedge shaped pattern.

SUMMARY OF THE INVENTION

In accordance with the present invention, the third or tertiary nozzle outlet is formed laterally adjacent the range nozzle outlet and above the spreader nozzle outlet, and receives water from a pressure reducing chamber formed in the nozzle to supply water to the spreader nozzle outlet. A relatively small cross- sectioned size flow port is formed between the chamber and the tertiary nozzle outlet, and which functions to substantially reduce the pressure of water flowing to the tertiary nozzle outlet from the chamber. The tertiary nozzle outlet, however, is formed to have a relatively large cross-sectioned size whereby water projected from the tertiary nozzle outlet will have very low energy and produce a low pressure, low velocity spray of relatively large droplet size which falls-out close into the sprinkler, preferably over an area extending from immediately adjacent the sprinkler outwardly approximately six to eight feet away.

These and many other features and advantages of the present invention will become more apparent from the following detailed description taken in conjunction with the drawings which disclose, by way of example, the principles of the invention.

BRIEF DESCRIPTION OF THE DRAWINGS

FIG. 3 is an enlarged fragmentary cross-sectional view taken substantially along the line 3—3 of FIG. 2;

FIG. 5 is a fragmentary cross- sectional view taken substantially along the line 5—5 of FIG. 2; and FIG. 6 is a schematic diagram of the precipitation patterns produced by a sprinkler nozzle constructed in accordance with the principles of the present invention as compared with that of a prior art sprinkler nozzle when operated at a supply pressure of approximately 60 p.s.i.

DETAILED DESCRIPTION OF THE PRESENTLY PREFERRED EMBODIMENT

Figure 1:
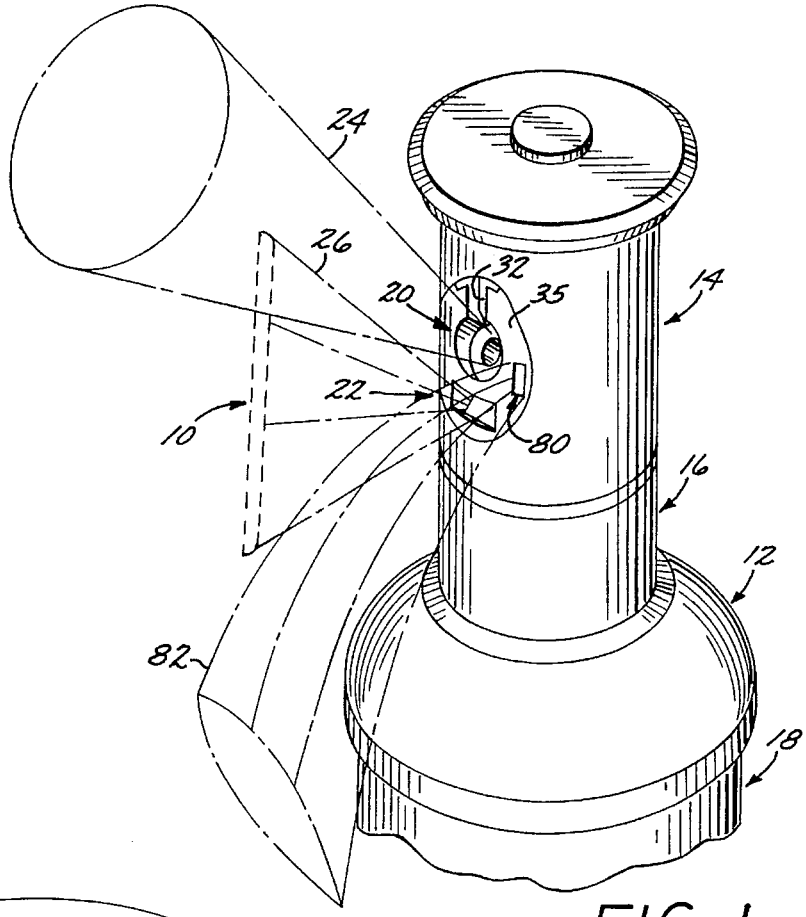
FIG. 1 is a fragmentary perspective view of a new and improved nozzle construction embodying the principles of the present invention, and shown installed in a pop-up rotary irrigation sprinkler.
Figure 2:
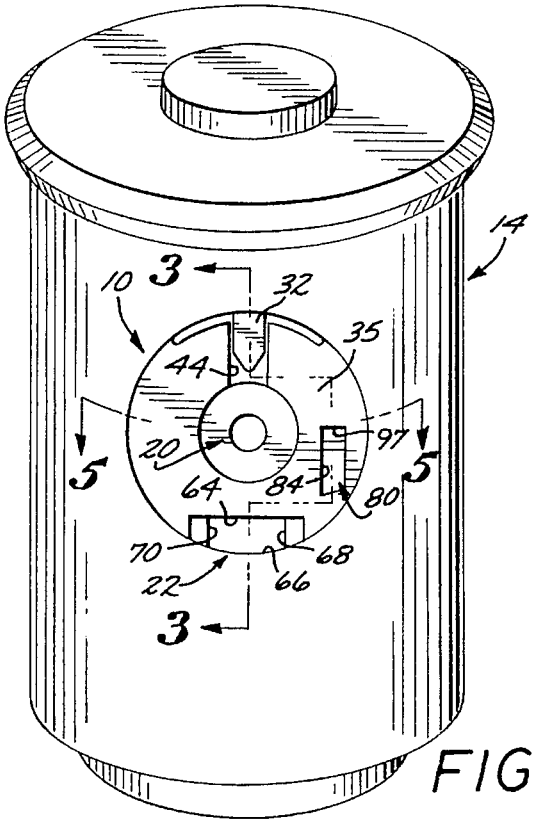
FIG. 2 is an enlarged isolated perspective view of the nozzle of FIG. 1 removed from the rotary sprinkler.

As shown in the exemplary drawings, the present invention is embodied in the new and improved irrigation sprinkler nozzle 10 primarily intended for use in a pop-up rotary irrigation sprinkler 12, and which incorporates the principles of the invention described in U.S. Pat. No. 5,299,742, the disclosure of which is incorporated herein by this reference. In this instance, as best seen in Figure 1, the nozzle 10 of the invention is shown mounted in a cylindrical rotary nozzle housing 14 coupled to a pop-up riser 16 supported by a sprinkler case 18 and includes a large water volume range nozzle outlet 20 and a smaller water volume spreader nozzle outlet 22, each of which are constructed in accordance with the principles of the invention disclosed in the aforementioned '742 patent. Water exiting the range nozzle outlet 20 is projected upwardly and laterally outwardly from the nozzle housing 14 as a generally columnated water stream 24, and water ejected from the spreader nozzle outlet 22 is projected laterally outwardly as a generally vertically oriented fan shaped spray 26. The sprinkler case 18 herein is of the type adapted to be buried in the ground and is coupled with a source of pressurized water (not shown) which supplies pressurized irrigating water through the riser 16 to the nozzle 10 typically at supply pressures ranging between about 30 p.s.i. and 80 p.s.i.

As can best be seen in FIGS. 3 and 5, water entering the nozzle housing 14 from the riser 16 passes through a generally vertically directed tubular conduit 28 into a curved, elbow shaped converging water passage 30 where it is turned approximately 65 degrees before entering the nozzle 10. The nozzle 10 herein is formed, preferably of molded plastic, by a generally cylindrical body 34 dimensioned to be received within a generally cylindrical cavity 36 formed laterally in the nozzle housing 14, and has a converging passageway 38 leading to the range nozzle outlet 20 having an entrance end 40 disposed to be axially aligned with, and of substantially the same cross sectional size as the cross sectional size of the outlet from the elbow shaped water passage 30 in the nozzle housing. Preferably, the nozzle 10 is press fit into the cylindrical cavity 36 of the nozzle housing 14, and includes a suitable seal, herein a lip type seal 42, formed annularly around the rear of the nozzle body 34 to provide a fluid tight seal between the nozzle body and the nozzle housing. Preferably, the face 35 of the nozzle body 34 is formed to be curved to match the curvature of the sides of the nozzle housing 14 so that the face will be substantially flush with the nozzle housing to prevent dirt or sand from building up between the nozzle and nozzle housing. To hold the nozzle body 34 in position within the cylindrical cavity 36, a threaded screw 32 is mounted to the nozzle housing 14 to project through an opening 44 formed in the nozzle, the screw serving to not only hold the nozzle within the housing, but also to function as a conventional break up pin which can be moved to project into the stream 24 from the range nozzle outlet 20, in a manner well known to those familiar with rotary sprinkler nozzles.

With primary reference to FIGS. 3, 4 and 5, the spreader nozzle outlet 22 receives pressurized water from an arcuate pressure reducing chamber 46 herein formed in the nozzle body 34 below the converging passageway 38 leading to the range nozzle outlet 20, and this chamber is, in turn, fed by a downwardly open inlet 48 formed in the body adjacent the entrance end 40 of the converging passageway. The inlet 48 to the chamber 46 is formed to bleed pressurized water from the entrance end 40 adjacent the elbow passage 30 along its lower side wall portion where maximum water swirl is produced, as more specifically described in the aforementioned '742 patent and U.S. Pat. No. 3,924,809 referred to therein. In this respect, sand and grit typically have densities about three times that of water and thus tend to accelerate less rapidly than the water in which it is entrained. For this reason, centrifugal force causes sand and grit entrained in the water to tend to concentrate on the outside of the curvature of the elbow shaped passage 30 where the curvature is more gradual. The larger the sand or grit particle, the larger the centrifugal forces tending to hold it to the outside of the elbow shaped water passage 30 so that by bleeding water into the chamber 46 and turning the water ninety degrees downwardly through the inlet 48 at the lower, more sharply curving portion of the elbow shaped passageway, any sand and grit particles that do pass through the inlet opening into the chamber tend to be relatively small in size, thereby reducing the likelihood of blockage or clogging due to water passing through the inlet 48.

When mounted to the nozzle housing 14, the chamber 46 herein is formed in the nozzle body 34 to have generally rectangular horizontal cross section defined by an arcuate bottom wall 50 formed by a portion of the inside wall of the cylindrical cavity 36 of the nozzle body 34, an arcuate top wall 52 and laterally spaced, generally radially directed end walls 54 and 56. The chamber 46 also has a rear wall 58 formed by an annulus 60 at the base of the cavity 36 within which the nozzle body 34 is mounted, and the inlet opening 48 into the chamber 46 is herein formed as a generally rectangular shaped notch 62 formed in the top wall 52 at the rear of the nozzle body 34 so as to permit communication between the rear of the chamber 46 and the water flowing through the elbow passage 30 to the converging passageway 38 leading to the range nozzle outlet 20. Preferably, as best seen in FIG. 5, the inner or rear edge of the nozzle body 34 surrounding the entrance to the range nozzle passageway 38 is formed with a lip 41 which presses tightly against the inside wall of the passage 30 at the junction with the nozzle body 34 to provide a water tight seal which prevents water from seeping into the chamber 46 outside the inlet opening 48. Thus, a portion of the water flowing through the elbow shaped passage 30 will bleed into the chamber 46 by turning approximately 90 degrees downwardly through the inlet opening 48.

The spreader nozzle outlet 22 has a substantially rectangular shape with its long dimension extending laterally of the center line through the range nozzle outlet 20 and is defined by horizontal upper and lower sides 64 and 66, respectively, and vertical ends 68 and 70. The lateral spacing between the ends 68 and 70 is substantially less than the lateral spacing between the end walls 54 and 56 of the chamber 46, thereby defining a pair of front walls 72 and 74 which cause water passing through the chamber to be directed laterally inwardly toward each other to intersect at a vertical plane through the center line of the spreader nozzle outlet which, in turn, produces a vertically oriented fan shaped spray 26, as described in the aforementioned '742 patent. Preferably, the spreader nozzle outlet 22 is dimensioned to produce a spray that falls-out over an area approximately eight to twenty five feet away from the sprinkler 10, thereby to insure that spray does not erode the soil or wash away newly planted seed.

In accordance with the present invention, a third or tertiary nozzle outlet 80 is provided in the nozzle body 34 to produce a relatively low pressure, low volume spray, generally designated 82 in FIG. 1, and which falls out close in to the sprinkler 12 to gently irrigate an area extending from immediately adjacent the sprinkler outwardly approximately six to eight feet without causing appreciable soil erosion or seed displacement. Moreover, the tertiary nozzle outlet 80, although fed by a relatively small size passage, is highly resistant to clogging, and produces a precipitation pattern which, when combined with the precipitation patterns produced by the spreader and range nozzles 22 and 20, respectively, results in an overall distribution pattern which closely approximates the ideal wedge-shaped pattern.

Toward the foregoing ends, the tertiary nozzle outlet 80 is formed as a relatively large, herein rectangular shaped opening disposed laterally adjacent the range nozzle outlet 20 and above the spreader nozzle outlet 22 with its long dimension being generally vertical. Water is fed to the tertiary nozzle outlet 80 through a relatively small sized port 88 located through the wall at one end of the chamber 46, herein the left end wall 54 as shown in FIG. 4 and which in turn communicates with the tertiary nozzle outlet through a relatively large size passage 90. By employing a small size port 88 between the chamber 46 and the tertiary nozzle outlet 80, substantial pressure drop can be created to produce a low pressure, low volume spray. Moreover, since the water passing through the port 88 must undergo two successive substantially right angle bends, the movement of grit and sand particles into and through the port is inhibited, thereby reducing the possibility of blockage.

Figure 4:
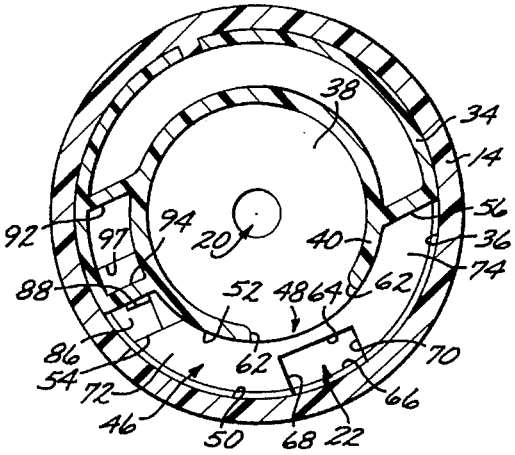
FIG. 4 is an enlarged fragmentary cross-sectional view taken substantially along the section line 4—4 of FIG. 3.

More specifically, as best can be seen in FIGS. 4 through 6, an upwardly extending recess 86 is formed in the end wall 54 at the left end of the chamber 46 (as viewed from the rear), and through which is formed the upwardly and slightly forwardly opening port 88 so that water can flow from the chamber into the forwardly extending, herein diverging passage 90 leading to the tertiary nozzle outlet 80. In this instance, the passage 90 is generally rectangular in vertical cross- section and includes a first rear portion defined by top and bottom generally parallel walls 92 and 93, an intermediate portion having generally parallel walls 94 and 95 which slope downwardly relative to the centerline axis of the range nozzle 20, and a forward portion wherein the upper wall 97 slopes upwardly toward the outlet 80, thereby to form the diverging passage. A principal reason for forming the passage 90 in this manner is to permit a straight line core pull during the molding process, and it is considered well within the scope of the present invention to form the passage 90 by other molding and/or machining techniques to have different cross-sectional shapes. The primary goal, however, is to insure that the passage 90 and outlet 80 are large in comparison to the cross-section of the port 88 so as to produce a substantial energy loss between the chamber 46 and tertiary nozzle outlet.

Notably, since water flowing through the port 88 is required to turn approximately 180 degrees from its direction of travel through the inlet opening 48 into the chamber 46, any dense sand and grit particles in the water are effectively filtered out of the stream flowing to the tertiary nozzle outlet 80 as they are not able to accelerate around the bends necessary to reach the port 88 and the tertiary nozzle outlet.

Preferably, the cross-sectional areas of the inlet 48 and spreader nozzle outlet 22 are selected to produce approximately a fifty percent pressure drop in the chamber 46 as compared with the pressure of the water flowing into the nozzle 10 from the riser 16, and the port 88 is dimensioned to further reduce the water pressure so that the resultant total energy of the water sprayed from the tertiary nozzle outlet 80 will be only about ten percent of the initial stream energy from the riser. This can be achieved by forming the cross-sectional size of the port 88 to be on the order of 0.016 square inches and the cross-sectional size of the passage 90 to be on the order of about 0,025 square inches at its smallest point. Notably, however, due to the tortious nature of the pathway leading from the elbow 30 into the nozzle 10 and through the chamber 46 to the tertiary nozzle outlet 80, even though the cross-sectional size of the port 88 is quite small, it will not become ineffective due to the blockage by particulate matter such as sand and grit.

In a presently preferred embodiment of a nozzle 10 employing the present invention, the axis of the range nozzle outlet 20 is disposed to be approximately 25 degrees above the horizontal, and the lower side 94 of the passage 90 leading to the tertiary nozzle outlet 80 is inclined 20 degrees downwardly relative to the range nozzle outlet axis so that the flow to the tertiary nozzle outlet is inclined approximately 5 degrees above the horizontal. Thus, water exiting the tertiary nozzle outlet 80 is directed outwardly with very low total energy and at an angle only slightly above the horizontal, thereby producing a low pressure, low volume spray 82 which falls out very close to the sprinkler 12. Moreover, due to the very substantial drop in energy of water exiting from the tertiary nozzle outlet 80, the resultant water droplets comprising the spray 82 will be relatively large, thereby reducing the problems caused by wind induced drift.

Illustrated in FIG. 6 is a graph comparing the fall out or precipitation pattern of a nozzle constructed in accordance with the present invention (solid line curve) with that of a conventional two outlet nozzle constructed in accordance with the teachings of the aforementioned '742 patent (broken line curve) when operated at approximately 60 pounds per square inch supply pressure. In this instance, the range nozzle 20 is dimensioned to project a columnated stream 24 that falls-out between approximately 25 and 60 feet away, the spreader nozzle outlet 22 being dimensioned to produce a spray 26 that falls-out between approximately eight and twenty five feet away, and the tertiary nozzle outlet producing a spray that falls- out between zero and approximately eight feet away. As can be seen in that graph, the provision of the tertiary nozzle outlet 80 substantially enhances the precipitation rate of water in the immediate area around the sprinkler, particularly between zero and eight feet away. Additionally, since the tertiary nozzle outlet provides an additional water outlet, the precipitation rate from the range nozzle toward the area of maximum range, herein shown between approximately forty five and sixty feet, is somewhat reduced over that achieved with the prior art nozzle, although the maximum distance of throw remains substantially unchanged. The net effect, however, is that the overall combined precipitation pattern produced by the nozzle constructed in accordance with the present invention as compared with that of the prior art '742 patent nozzle is a substantially enhanced pattern which very closely approximates the ideal straight line wedge-shaped pattern.

From the foregoing, it should be apparent that the provision of the tertiary nozzle outlet 80 results in a nozzle construction which substantially enhances the overall distribution pattern produced by prior art nozzles of the type including range nozzle and spreader nozzle outlets. Moreover, the nozzle 10 of the present invention is relatively simple in design, economical to manufacture, and highly reliable in use, yet is resistant to clogging and blockage due to particulate matter entrained in the water supply. While a particular form of the present invention has been illustrated and described, it should be apparent that various modifications and changes can be made without departing from the spirit and scope of the invention.

What is claimed is:

1. An irrigation sprinkler nozzle adapted to be mounted to a rotary sprinkler unit for applying water admitted to the sprinkler unit from a pressurized source over an arcuate area extending from the sprinkler unit outwardly a predetermined distance, said irrigation sprinkler nozzle comprising:

a nozzle body adapted to be mounted to said rotary sprinkler unit;

an elongated water flow passageway extending through said nozzle body, one end of said flow passageway being adapted to receive water from said pressurized source, and the other end of said passageway terminating in a range nozzle outlet for projecting a columnated water stream upwardly and outwardly away from said sprinkler unit, said columnated stream being composed of relatively high energy water for irrigating an area extending from a first location away from said sprinkler unit outwardly thereof to said predetermined distance;

a spreader nozzle outlet formed in said nozzle body vertically below said range nozzle outlet, said spreader nozzle outlet communicating with said elongated water flow passageway through a pressure reducing chamber formed in said nozzle body below said passageway to produce a spray composed of relatively lower energy water for irrigating an area extending from a second location away from said sprinkler unit outwardly thereof to approximately said first location, said pressure reducing chamber including an inlet passage communicating with said water flow passageway rearwardly of said range nozzle outlet, said inlet passage being formed to extend downwardly from said passageway into said chamber to cause water flowing therethrough from said flow passageway into said chamber to undergo a directional change of approximately one hundred eighty degrees; and a tertiary nozzle outlet formed in said nozzle body, said tertiary nozzle outlet communicating with said pressure reducing chamber through a flow port dimensioned to substantially reduce the pressure of water flowing from said chamber to said tertiary nozzle outlet to produce a spray of low energy which falls-out over an area extending form immediately adjacent said sprinkler unit outwardly to approximately said second location.

2. An irrigation sprinkler nozzle as set forth in claim 1 wherein said tertiary nozzle outlet is disposed above said sprinkler nozzle outlet and laterally of said range nozzle outlet.

3. An irrigation sprinkler nozzle as set forth in claim 2 wherein said spreader nozzle outlet and said chamber are cooperatively formed to produce a generally vertically oriented fan-shaped spray.

4. An irrigation sprinkler nozzle as set forth in claim 3 wherein said pressure reducing chamber and said spreader nozzle outlet are cooperatively formed to reduce the pressure within said chamber to approximately one half that of the pressure of said pressurized source.

5. An irrigation sprinkler nozzle as set forth in claim 4 wherein said flow port is dimensioned to reduce the pressure of water passing therethrough from said pressurized source to said tertiary nozzle outlet by approximately ninety percent.

6. An irrigation sprinkler nozzle as set forth in claim 5 wherein said port has a cross-sectioned size of approximately 0.016 square inches.

7. An irrigation sprinkler nozzle adapted to be mounted to a rotary sprinkler unit for applying water admitted to the sprinkler unit from a pressurized source over an arcuate area extending from the sprinkler unit outwardly a predetermined distance, said irrigation sprinkler nozzle comprising:

a nozzle body adapted to be mounted to said rotary sprinkler unit;

an elongated water flow passageway extending through said nozzle body, one end of said flow passageway being adapted to receive water from said pressurized source, and the other end of said passageway terminating in a range nozzle outlet for projecting a columnated water stream upwardly and outwardly away from said sprinkler unit, said columnated stream being composed of relatively high energy water for irrigating an area extending from a first location away from said sprinkler unit outwardly thereof to said predetermined distance;

a spreader nozzle outlet formed in said nozzle body vertically below said range nozzle outlet, said spreader nozzle outlet communicating with said elongated water flow passageway through a pressure reducing chamber having a downwardly opening inlet formed in said nozzle body below said passageway to produce a spray composed of relatively lower energy water for irrigating an area extending from a second location away from said sprinkler unit outwardly thereof to approximately said first location said downwardly opening inlet causing water flowing therethrough between said flow passageway and said chamber to undergo a directional change of approximately one hundred eighty degrees; and a tertiary nozzle outlet formed in said nozzle body above said spreader nozzle outlet and laterally of said range nozzle outlet, said tertiary nozzle outlet communicating with said pressure reducing chamber through a substantially upwardly opening flow port dimensioned to substantially reduce the pressure of water flowing from said chamber to said tertiary nozzle outlet, said flow port causing water flowing therethrough from said chamber to said tertiary nozzle outlet to undergo two successive directional changes of approximately ninety degrees each, thereby to produce a spray of low energy which falls-out over an area extending from immediately adjacent said sprinkler unit outwardly to approximately said second location.

8. An irrigation sprinkler nozzle as set forth in claim 7 wherein said spreader nozzle outlet and said chamber are cooperatively formed to produce a generally vertically oriented fan-shaped spray.

9. An irrigation sprinkler nozzle as set forth in claim 7 wherein said second location is approximately eight feet away from said sprinkler unit.

10. An irrigation sprinkler nozzle as set forth in claim 7 wherein said pressure reducing chamber is formed by vertically spaced upper and lower arcuate walls interconnected by a pair of laterally spaced generally radial ends, and said flow port is formed in one of said ends.

11. An irrigation sprinkler nozzle as set forth in claim 10 wherein said port has a cross-sectioned size of approximately 0.016 square inches.

12. An irrigation sprinkler nozzle as set forth in claim 11 wherein said second location is approximately eight feet away from said sprinkler unit.

13. An irrigation sprinkler nozzle as set forth in claim 7 wherein said flow port is dimensioned to reduce the pressure of water passing therethrough from said pressurized source to said tertiary nozzle outlet by approximately ninety percent.

14. An irrigation sprinkler nozzle as set forth in claim 13 wherein said pressure reducing chamber and said spreader nozzle outlet are cooperatively formed to reduce the pressure within said chamber to approximately one half that of the pressure of said pressurized source.

15. An irrigation sprinkler nozzle adapted to be mounted to a rotary sprinkler unit for applying water admitted to the sprinkler unit from a pressurized source over an arcuate area extending from the sprinkler unit outwardly a predetermined distance, said irrigation sprinkler nozzle comprising:

a molded plastic nozzle body adapted to be mounted to said rotary sprinkler unit;

an elongated water flow passageway extending through said nozzle body, one end of said flow passageway being adapted to receive water from said pressurized source, and the other end of said passageway terminating in a range nozzle outlet for projecting a columnated water stream upwardly and outwardly away from said sprinkler unit, said columnated stream being composed of relatively high energy water for irrigating an area extending from a first location away from said sprinkler unit outwardly thereof to said predetermined distance;

a spreader nozzle outlet formed in said nozzle body vertically below said range nozzle outlet, said spreader nozzle outlet communicating with said elongated water flow passageway through a pressure reducing chamber formed in said nozzle body below said passageway to produce a spray composed of relatively lower energy water for irrigating an area extending from a second location away from said sprinkler unit outwardly thereof to approximately said first location, said chamber including an inlet passage communicating with said passageway rearwardly of said range nozzle outlet and formed to extend vertically downwardly whereby water from said passageway is turned approximately ninety degrees when flowing into said chamber; and a tertiary nozzle outlet formed in said nozzle body above said spreader nozzle outlet and laterally of said range nozzle outlet, said tertiary nozzle outlet communicating with said pressure reducing chamber through a substantially vertically upwardly disposed flow port dimensioned to substantially reduce the pressure of water flowing from said chamber to said tertiary nozzle outlet to produce a spray of low energy which falls-out over an area extending from immediately adjacent said sprinkler unit outwardly to approximately said second location.

16. An irrigation sprinkler nozzle as set forth in claim 15 wherein said chamber has a generally rectangular horizontal cross-section and an arcuate vertical cross-section formed by vertically spaced upper and lower arcuate walls interconnected by a pair of generally radially directed laterally spaced end walls, said flow port being formed to extend through one of said pair of laterally spaced end walls.

17. An irrigation sprinkler nozzle as set forth in claim 16 wherein said tertiary nozzle outlet is substantially larger in cross-section than the cross-sectioned size of said flow port.

18. An irrigation sprinkler nozzle as set forth in claim 17 wherein said chamber communicates with said elongated water flow passageway through a downwardly opening inlet formed in said nozzle body adjacent said one end of said passageway, and said spreader nozzle outlet is formed to produce a generally vertically oriented fan-shaped spray.

19. An irrigation sprinkler nozzle as set forth in claim 18 wherein said cross-sectioned size of said inlet and said spreader nozzle outlet are dimensioned to reduce the pressure of water flowing through said inlet from said passageway by approximately fifty percent.

20. An irrigation sprinkler nozzle as set forth in claim 19 wherein said cross- sectioned size of said flow port and said tertiary nozzle outlet are dimensioned to reduce the pressure of water flowing through said port from said chamber by approximately eighty percent.

21. An irrigation sprinkler nozzle as set forth in claim 20 wherein said cross-sectioned size of said flow port is approximately 0.016 square inches.

22. An irrigation sprinkler nozzle as set forth in claim 21 wherein said cross-sectioned size of said tertiary nozzle is at least about 0.025 square inches.

* * * * *